US007544036B1

(12) United States Patent
Randall et al.

(10) Patent No.: US 7,544,036 B1
(45) Date of Patent: Jun. 9, 2009

(54) COLUMN SELECTOR FOR PIPE SECTION MAGAZINE OF DIRECTIONAL DRILL

(75) Inventors: Guy Randall, Wooster, OH (US); Christopher A. Huck, Wadsworth, OH (US)

(73) Assignee: Astec Industries, Inc., Chattanooga, TN (US)

( * ) Notice: Subject to any disclaimer, the term of this patent is extended or adjusted under 35 U.S.C. 154(b) by 453 days.

(21) Appl. No.: 11/337,417

(22) Filed: Jan. 23, 2006

(51) Int. Cl.
*B66F 11/00* (2006.01)
*E21B 19/00* (2006.01)

(52) U.S. Cl. ..... 414/746.4; 414/745.5; 414/22.62; 175/52

(58) Field of Classification Search ..... 414/22.53, 414/22.62, 745.7, 746.4, 797.7; 175/52; 221/99, 152, 95
See application file for complete search history.

(56) References Cited

U.S. PATENT DOCUMENTS

| | | | | |
|---|---|---|---|---|
| 2,504,547 | A * | 4/1950 | Edward | 84/385 R |
| 2,780,376 | A | 2/1957 | Sanders | |
| 4,834,195 | A | 5/1989 | Robinson | |
| 5,607,280 | A | 3/1997 | Rozendaal | |
| 5,791,822 | A | 8/1998 | Edmondson et al. | |
| 6,074,153 | A | 6/2000 | Allen | |
| 6,085,852 | A | 7/2000 | Sparks et al. | |
| 6,179,065 | B1 | 1/2001 | Payne et al. | |
| 6,237,703 | B1 | 5/2001 | Draney et al. | |
| 6,283,702 | B1 | 9/2001 | Devlugt et al. | |
| 6,332,502 | B1 | 12/2001 | Mills et al. | |
| 6,360,830 | B1 | 3/2002 | Price | |
| 6,374,927 | B1 | 4/2002 | Guterman et al. | |
| 6,374,928 | B1 | 4/2002 | Teller et al. | |
| 6,408,954 | B1 | 6/2002 | Price et al. | |
| 6,474,931 | B1 | 11/2002 | Austin et al. | |
| 6,533,046 | B2 | 3/2003 | Mills et al. | |
| 6,543,551 | B1 | 4/2003 | Sparks et al. | |
| 6,550,547 | B1 | 4/2003 | Payne et al. | |
| 6,702,043 | B2 | 3/2004 | Koch et al. | |
| 6,814,164 | B2 | 11/2004 | Mills et al. | |
| 2002/0079137 | A1 | 6/2002 | Mills et al. | |
| 2002/0153169 | A1 | 10/2002 | Sewell | |
| 2004/0007388 | A1 | 1/2004 | Mills et al. | |
| 2004/0022605 | A1 | 2/2004 | Anthis et al. | |
| 2004/0129455 | A1 | 7/2004 | Koch et al. | |

* cited by examiner

*Primary Examiner*—Gregory W Adams
(74) *Attorney, Agent, or Firm*—Chambliss, Bahner & Stophel, P.C.

(57) ABSTRACT

A handling assembly for pipe sections for a horizontal directional drill includes a thrust frame and a pipe handler assembly track that is attached to the thrust frame so as to define a pipe section transfer location. The handling assembly also includes a pipe handler carrier that is mounted on the pipe handler assembly track and a magazine that is mounted adjacent to the pipe handler carrier and adapted to discharge a pipe section from the bottom of a selected column to the pipe section transfer location. The pipe handler carrier may be moved along the pipe handler assembly track to a plurality of positions in each of which a pipe section at the bottom of a column of the magazine is aligned with the transfer location, and a column selector rod is mounted with respect to the thrust frame so as to selectively locate the pipe handler carrier along the pipe handler assembly track at a position to align a column of the magazine with the pipe section transfer location.

16 Claims, 10 Drawing Sheets

COLUMN SELECTOR FOR PIPE SECTION MAGAZINE OF DIRECTIONAL DRILL

FIELD OF THE INVENTION

This invention relates generally to a device for use with the pipe section magazine of a directional drilling machine in order to position a pipe section for insertion into the ground upon removal from the magazine or to position a pipe section for replacement in the magazine upon withdrawal from the ground. More particularly, the invention relates to an assembly for placing a pipe section in a transfer location that is aligned with one of the columns of the magazine.

BACKGROUND AND DESCRIPTION OF THE PRIOR ART

Many utility lines, pipelines and other underground components are installed in or under the ground by boring a borehole in a generally-horizontal direction in the ground rather than by digging a trench. This type of construction, which is sometimes referred to as "horizontal boring", "directional drilling" or "horizontal directional drilling", eliminates the need to excavate earth in order to install an underground component, and thereby saves several steps in the installation process. If no trench is dug, there will be no trench to fill, and no disturbed surface to reclaim. The horizontal drilling machine may be operated to drill a pilot bore along a planned path underground. Typically, the planned path is generally arcuate in shape from the entry point at the surface of the ground, continuing underneath a roadway, river or other obstacle, to the exit point at the surface on the other side of the obstacle.

A typical directional drilling machine includes a thrust frame that can be aligned at an oblique angle with respect to the ground. Mounted on a drive carriage on the thrust frame is a pipe-rotation mechanism that is adapted to rotate a series of interconnected pipe sections (commonly referred to as a drill string) about a boring axis. The drive carriage also includes a carriage drive assembly that is adapted to push the carriage along the thrust frame. The combination of rotation of the drill string and longitudinal movement of the drive carriage along the thrust frame causes the drill string to be advanced into or withdrawn from the ground.

To drill a hole using a directional drilling machine, the thrust frame is oriented at an oblique angle relative to the ground, and the drive carriage is retracted to an upper end of the frame. A pipe section is unloaded from a magazine and is coupled to the pipe-rotation mechanism on the drive carriage. A boring tool or cutting head is mounted to the distal end of the pipe, and the drive carriage is driven in a downward direction along the inclined thrust frame. As the drive carriage is driven downwardly, the pipe-rotation mechanism rotates the pipe about the boring axis, thereby causing the pipe (with boring tool mounted thereon) to drill or bore a hole.

As the drilling operation proceeds, the drill string is lengthened by adding pipe sections to the string. Typically, the pipe sections are provided with a male threaded connector on one end and a female threaded connector on the other end. Each time a pipe section is added to the drill string, the pipe section being added is aligned with the drill string and the threaded connector on its distal end is mated with the threaded connector on the proximal end of the drill string. Obviously, either the pipe section being added or the drill string must be restrained against rotation while the other component is rotated to engage the threaded connector on the distal end of the pipe section with the threaded connector on the proximal end of the drill string to create a secure threaded connection between the components.

During drilling using a horizontal directional drill, drilling fluid can be pumped through the drill string, over the boring tool at the distal end of the drill string and back up through the hole, to remove cuttings and displaced dirt. After the boring tool reaches a desired depth, it can be directed along a generally horizontal path and back up to break the surface of the ground at a distant point. To control the direction of the borehole, a boring tool with an angled-face may be used. When the direction of the borehole must be changed, the drill bit is positioned with the angled-face oriented in the desired direction. The drill string is then pushed through the ground without rotation, and the angled-face of the boring tool causes the drill string to deflect in the desired direction. This ability to change the direction of travel of the drill string also allows the operator to steer the drill string around underground obstacles like large roots and rocks.

Sufficient lengths of pipe are added to the drill string as needed to reach the exit point where the boring tool emerges from the earth. When the original bore is complete, it may be enlarged by replacing the boring tool with an enlarging device, commonly known as a backreamer. The backreamer is connected to the distal end of the drill string and moved through the original bore back towards the boring machine, either with or without rotation of the drill string. The backreamer expands and stabilizes the walls of the bore, generally while pulling a utility line or other underground component through the enlarged bore behind it. Movement of the backreamer back towards the drilling machine is accomplished by driving the drive carriage in a rearward direction on the thrust frame to withdraw a pipe section, disconnecting the withdrawn pipe section from the drill string, connecting the next pipe section in the drill string to the pipe rotation mechanism on the drive carriage and repeating the process until all of the pipe sections have been withdrawn from the ground. As each pipe section in the drill string is uncoupled from the drill string, it is loaded back into the pipe section magazine of the directional drilling machine.

To enhance drilling productivity, it is important to maximize the efficiency with which pipe sections can be loaded into and unloaded from the magazine. Until fairly recently, pipe sections were manually carried between the magazine and the pipe rotation mechanism of a drilling machine, and were also manually loaded into and unloaded from the magazine. Recent developments, however, have improved pipe loading and unloading efficiencies, primarily through automation.

It is well-known to store pipe sections in a magazine having a plurality of columns, within each of which a plurality of pipe sections are stored. Such magazines are disclosed in U.S. Pat. No. 5,607,280, U.S. Pat. No. 6,085,852, U.S. Pat. No. 6,179,065, U.S. Pat. No. 6,332,502, U.S. Pat. No. 6,360,830, U.S. Pat. No. 6,374,928, U.S. Pat. No. 6,408,954, U.S. Pat. No. 6,474,931, U.S. Pat. No. 6,533,046, U.S. Pat. No. 6,543,551, U.S. Pat. No. 6,550,547 and U.S. Pat. No. 6,814,164. It is also known to provide various assemblies and mechanisms for moving a pipe section between a magazine and a pipe rotation mechanism. The appropriate column for unloading or loading a pipe section is typically selected by moving a selection arm containing one or more pockets beneath the pipe magazine until a pocket is aligned with a desired column. In some pipe handling assemblies, such as those described in U.S. Pat. No. 5,607,280, U.S. Pat. No. 6,360,830 and U.S. Pat. No. 6,374,928, a pair of hydraulic cylinders, one on each side of the handling assembly, operate to move the selection arm to select a particular column so that a pipe section may be received therein. In other pipe handling assemblies, such as those described in U.S. Pat. No. 6,085,852, U.S. Pat. No. 6,179,065, U.S. Pat. No. 6,543,551 and U.S. Pat. No. 6,550,547, a selection arm is moved beneath the magazine by a pair of rack and pinion arrangements. All of these assemblies are somewhat complicated and require multiple expensive components which must cooperate with each other for proper operation. It would be desirable if a simpler and less expensive system could be devised that would allow an operator to select a magazine column for unloading or loading of pipe sections.

ADVANTAGES OF A PREFERRED EMBODIMENT OF THE INVENTION

Among the advantages of a preferred embodiment of the invention is that it provides a simple mechanical system that allows an operator to select a magazine column for unloading or loading of pipe sections.

Additional objects and advantages of this invention will become apparent from an examination of the drawings and the ensuing description.

Explanation of Technical Terms

The terms "above", "upwardly" and similar terms, as used herein to indicate the position of a component of a drilling machine assembly relative to another component, refer to a position higher in elevation when the assembly is in its normal operating configuration.

The terms "below", "downwardly" and similar terms, as used herein to indicate the position of a component of a drilling machine assembly relative to another component, refer to a position lower in elevation when the assembly is in its normal operating configuration.

As used herein, the "front" or "front end" of the drilling machine refers to the end on which the stakedown assembly is mounted.

As used herein, the "rear end" of the drilling machine is the end opposite the front end.

The term "forward" is used herein to describe the direction in which the drive carriage is driven along the thrust frame in order to push a pipe section into the ground.

The terms "backward", "rearward" and similar terms are used herein to describe the direction in which the drive carriage is driven along the thrust frame in order to withdraw a pipe section from the ground.

As used herein, the term "linear actuator" and similar terms refers to a mechanical, electric, hydraulic or electro-hydraulic device that generates force that is directed in a straight line. One common example of a linear actuator is a hydraulic cylinder which includes a cylinder, a piston within the cylinder, and a rod attached to the piston. By increasing the pressure within the cylinder on one side of the piston (over that on the opposite side of the piston), the rod will extend from the cylinder or retract into the cylinder. Other common examples of linear actuators are tension springs and compression springs.

SUMMARY OF THE INVENTION

The invention comprises a handling assembly for pipe sections for a horizontal directional drill. This handling assembly includes a thrust frame and a pipe handler assembly track that is attached to the thrust frame so as to define a pipe section transfer location. A pipe handler carrier is mounted on the pipe handler assembly track, and a magazine having a plurality of pipe section columns is mounted adjacent to the pipe handler carrier. A plurality of pipe sections may be received and stored in the magazine, and the magazine is adapted to discharge a pipe section from the bottom of a selected column to the pipe section transfer location. The handling assembly includes means for moving the pipe handler carrier along the pipe handler assembly track to a plurality of positions in each of which a pipe section at the bottom of a column of the magazine is aligned with the transfer location. A column selector rod is mounted with respect to the thrust frame so as to selectively locate the pipe handler carrier along the pipe handler assembly track at a position to align a column of the magazine with the pipe section transfer location.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
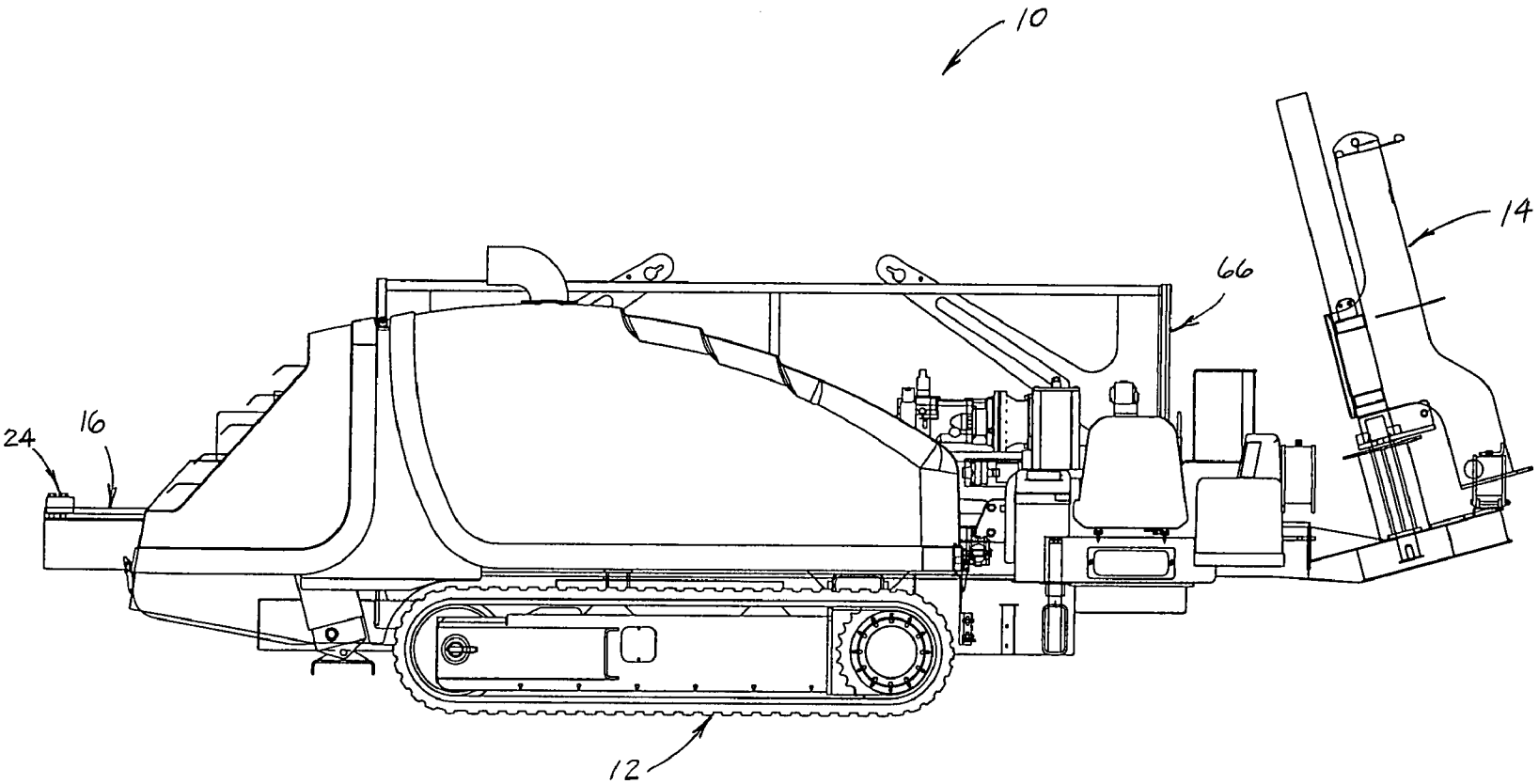
FIG. 1 is a side view of a horizontal directional drilling machine which includes a preferred embodiment of the invention.
Figure 2:
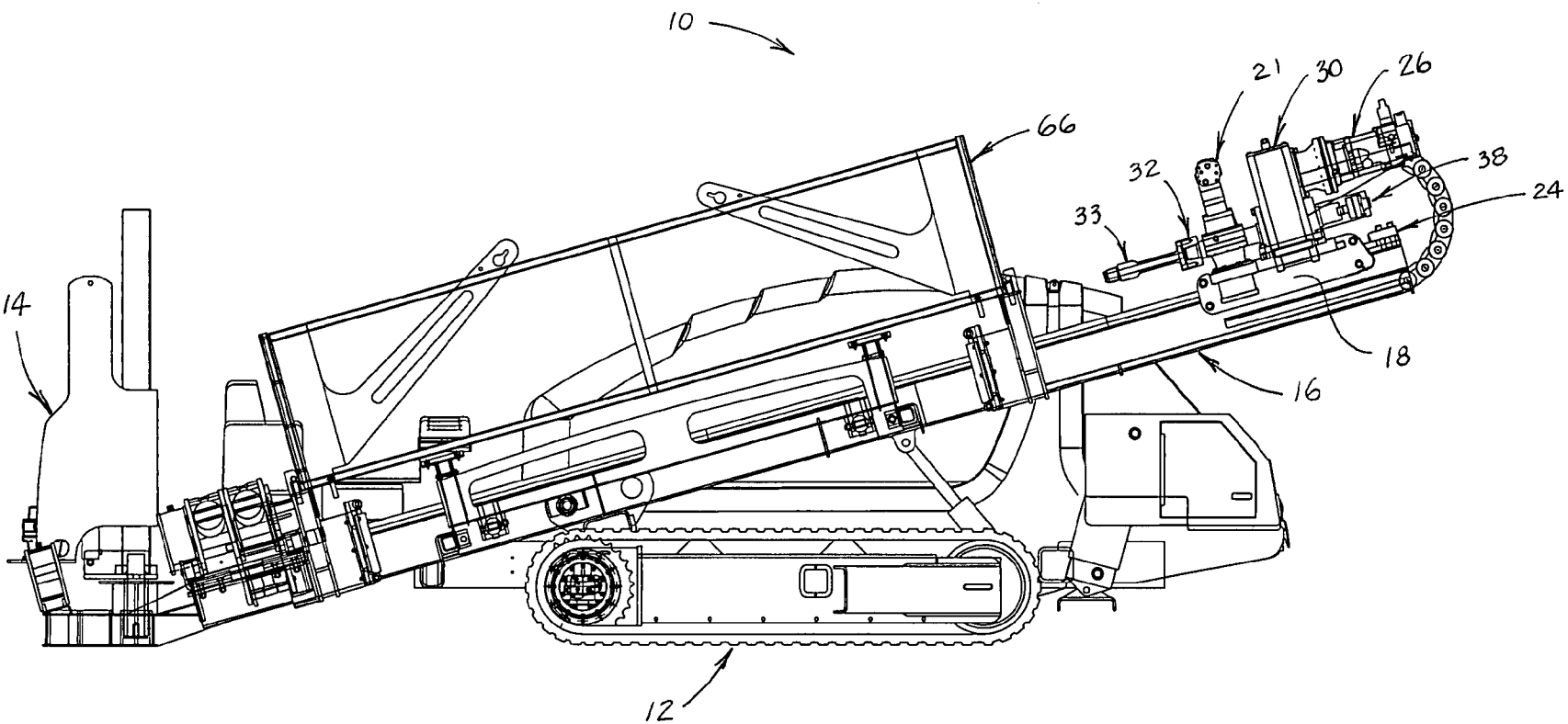
FIG. 2 is a view of the opposite side of the horizontal directional drilling machine of FIG. 1, with the thrust frame oriented at an oblique angle.

FIGS. 1 and 2 illustrate preferred embodiment 10 of a horizontal directional drilling machine. Machine 10 is driven by a conventional drive system, which includes track drive 12, an engine (not shown), and other conventional drive components (also not shown) as are known to those having ordinary skill in the art to which the invention relates. Stakedown assembly 14 is pivotally connected to the forward end of thrust frame 16 at the front end of drilling machine 10. When thrust frame 16 is tilted to the drilling position (as shown in FIG. 2), the pivotal connection of stakedown assembly 14 allows the stakedown assembly to be oriented level with the ground surface to assist in securing the machine in place.

Figure 3:
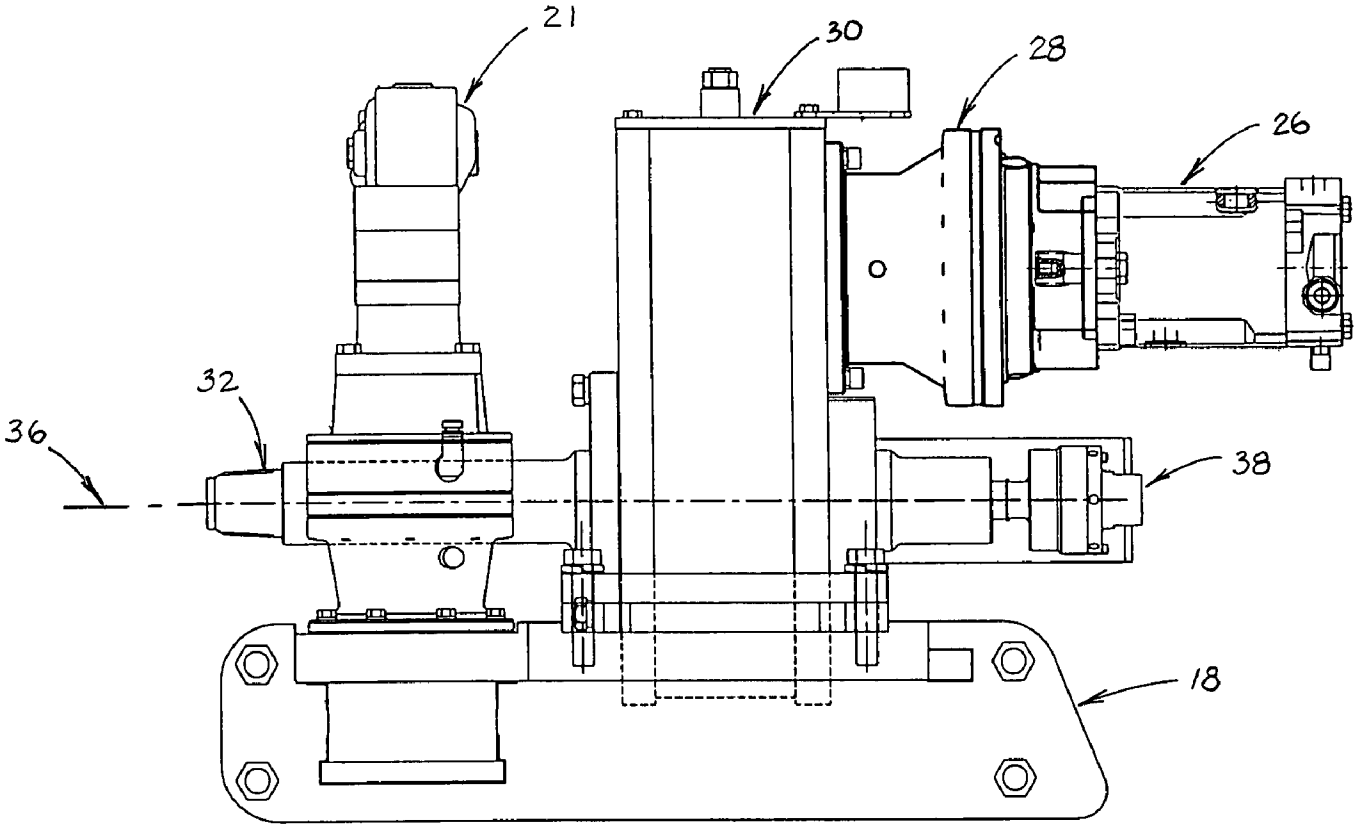
FIG. 3 is a side view of the drive carriage of the horizontal directional drilling machine of FIGS. 1 and 2.
Figure 4:
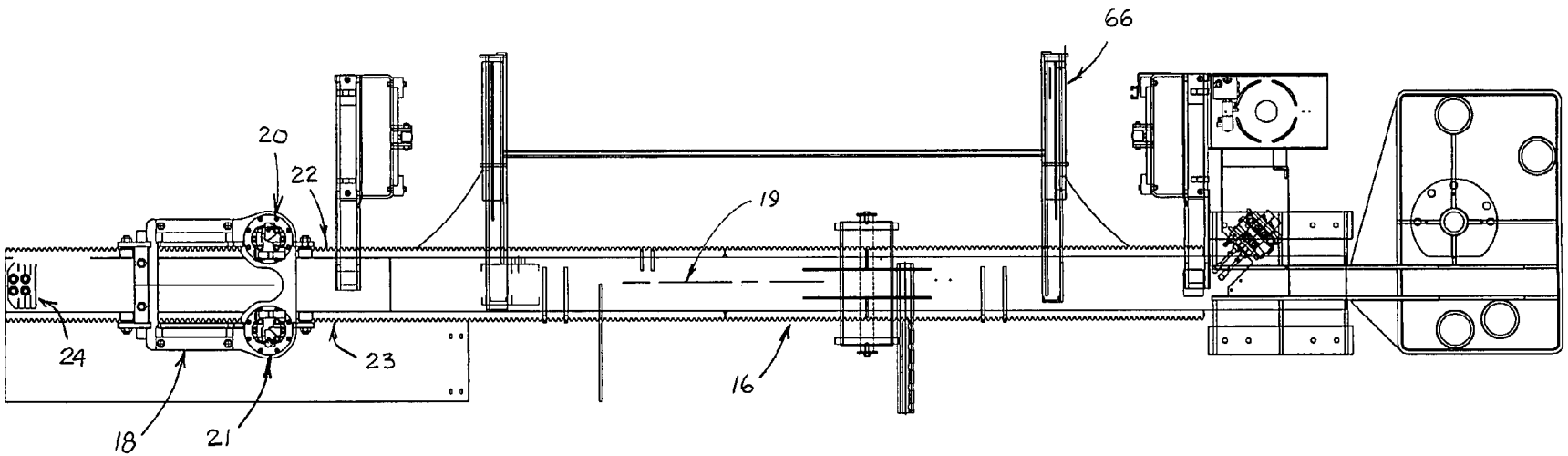
FIG. 4 is a top view of a portion of the horizontal directional drilling machine of FIGS. 1 and 2, including the drive carriage that is illustrated in FIG. 3 and the thrust frame.

Drive carriage 18 (best shown in FIGS. 2-4) is mounted on thrust frame 16 and adapted to be driven therealong (and along thrust frame axis 19) by a conventional carriage drive assembly which includes motors 20 and 21, each of which drives a pinion (not shown) that engages racks 22 and 23 (shown in FIG. 4) located on opposite sides of the thrust frame. A cushion 24 (shown in FIGS. 1, 2 and 4) is located at the rear end of thrust frame 16 and is adapted to safely stop the drive carriage when it is driven to the rear end of the thrust frame. Drive carriage 18 also includes a pipe-rotation mechanism comprising motor 26 which operates to transmit rotary motion through planetary gearbox 28 and rotary gearbox 30 to spindle 32 (shown in FIGS. 2-3). An adapter 33 is attached to spindle 32 and is threaded to engage with one end of a pipe section so that the pipe section can be secured to the pipe-rotation mechanism. The pipe-rotation mechanism and thrust frame 16 define a pipe section transfer location (best shown by the location of pipe section 34 in FIG. 8) above thrust frame 16 and along boring axis 36 (see FIG. 3). A pipe section (not shown in FIGS. 2-3) of a drill string may be attached to spindle 32 so that rotation of the spindle about boring axis 36 (which is parallel to thrust frame axis 19), coupled with movement of the drive carriage along thrust frame axis 19 towards the front of machine 10 will drive the drill string into the ground. Drive carriage 18 also includes drilling fluid connector 38, through which a supply of drilling fluid may be pumped by conventional means (not shown) during the drilling operation.

Figure 5:
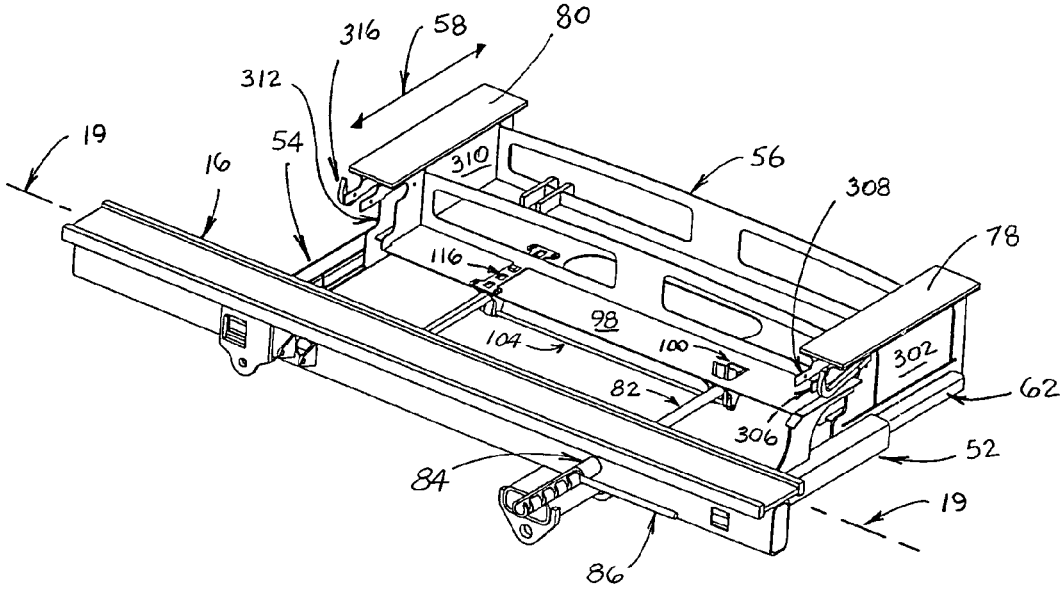
FIG. 5 is a top perspective view of a portion of a preferred embodiment of the invention.
Figure 6:
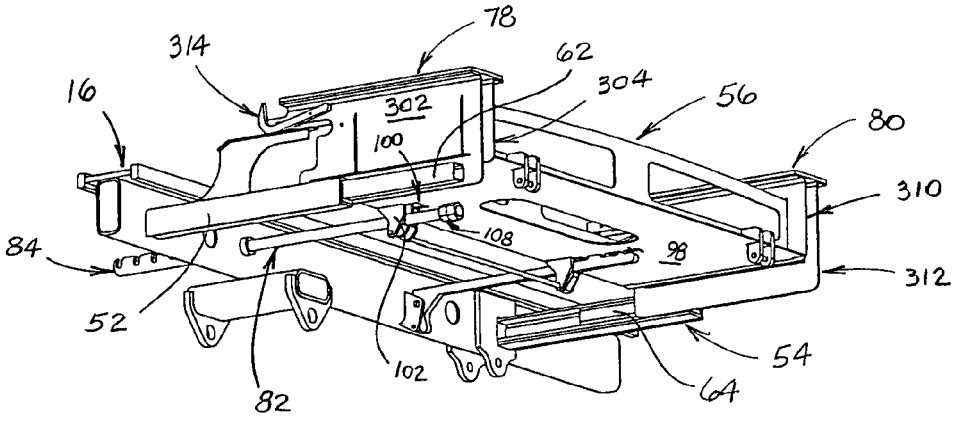
FIG. 6 is a bottom perspective view of the portion of the pipe handler assembly illustrated in FIG. 5.
Figure 7A:
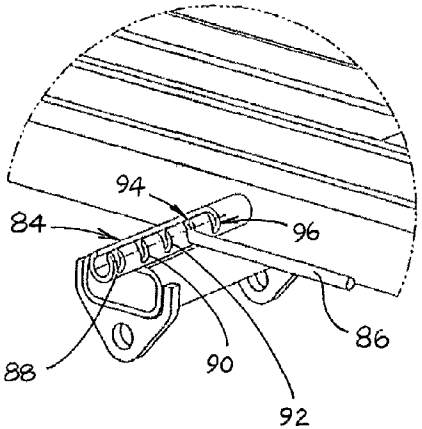
FIG. 7A is an illustration of a portion of the pipe handler assembly of FIGS. 5 and 6 showing a first step in aligning the pipe handler carrier with the pipe section magazine so as to align a column of the magazine with the pipe section transfer location.
Figure 7B:
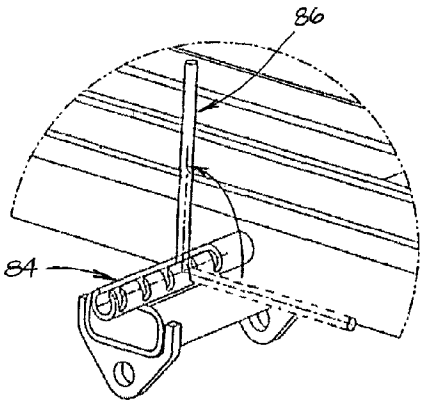
FIG. 7B is an illustration of a portion of the pipe handler assembly of FIGS. 5 and 6 showing a second step in aligning the pipe handler carrier with the pipe section magazine so as to align a column of the magazine with the pipe section transfer location.
Figure 7C:
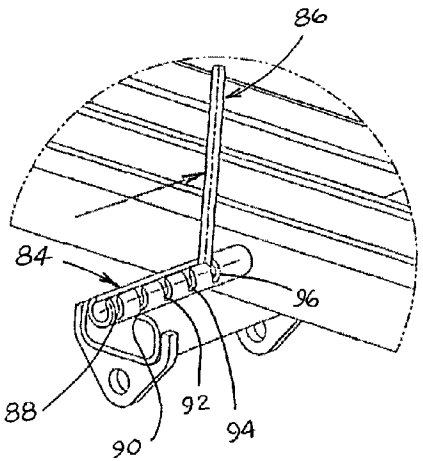
FIG. 7C is an illustration of a portion of the pipe handler assembly of FIGS. 5 and 6 showing a third step in aligning the pipe handler carrier with the pipe section magazine so as to align a column of the magazine with the pipe section transfer location.
Figure 7D:
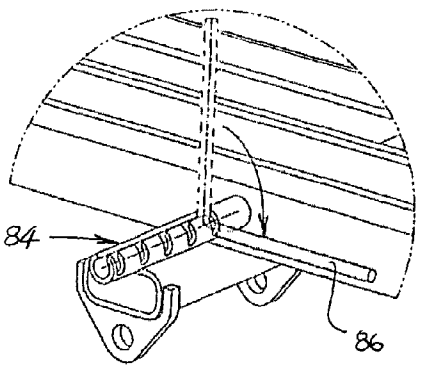
FIG. 7D is an illustration of a portion of the pipe handler assembly of FIGS. 5 and 6 showing a fourth step in aligning the pipe handler carrier with the pipe section magazine so as to align a column of the magazine with the pipe section transfer location.
Figure 8:
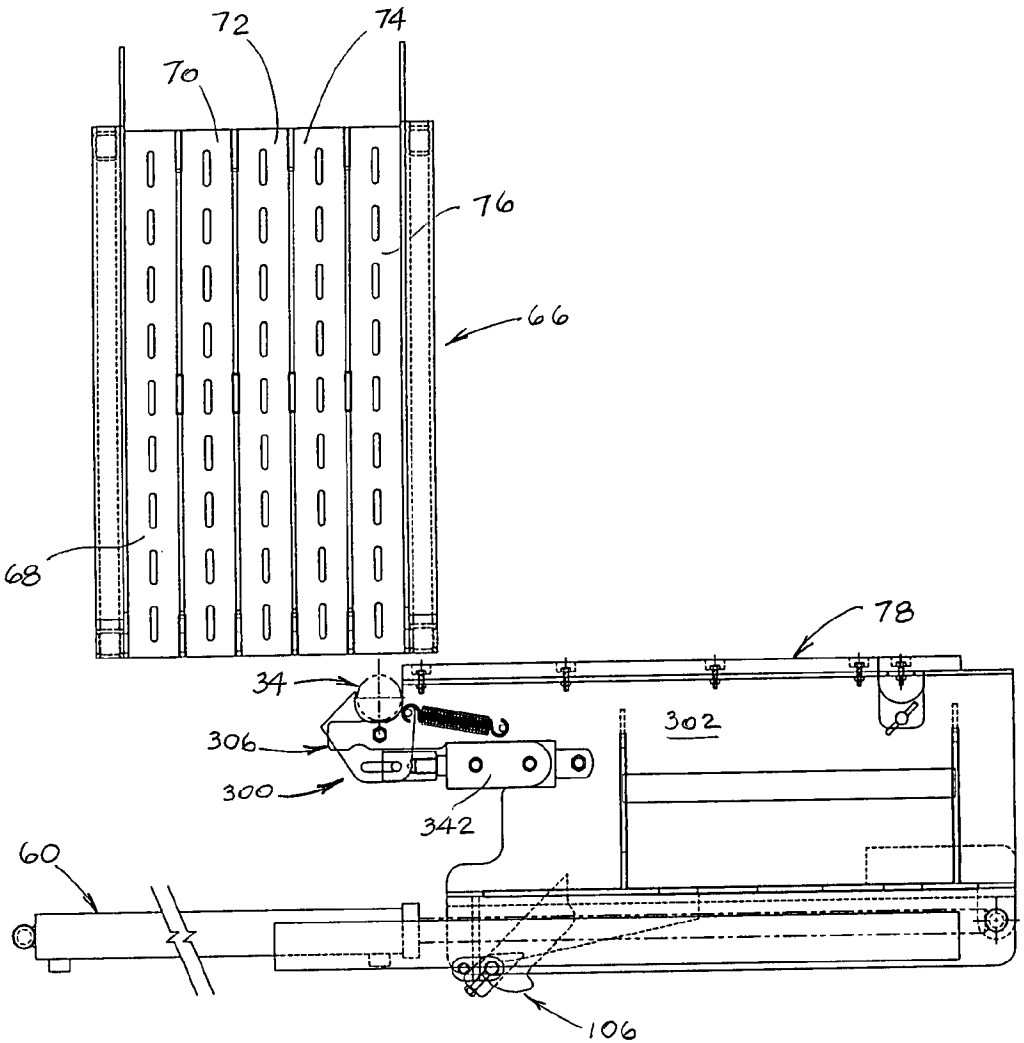
FIG. 8 is a side view of a portion of a preferred embodiment of the invention.
Figure 9A:
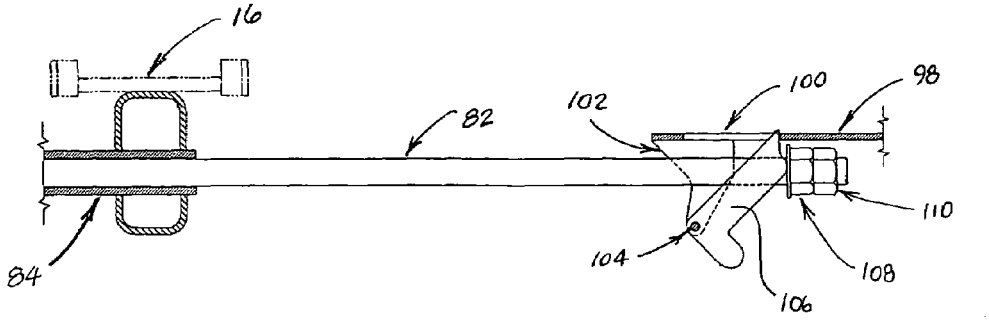
FIG. 9A is a partial view of a preferred embodiment of a first pipe handler stop assembly.
Figure 9B:
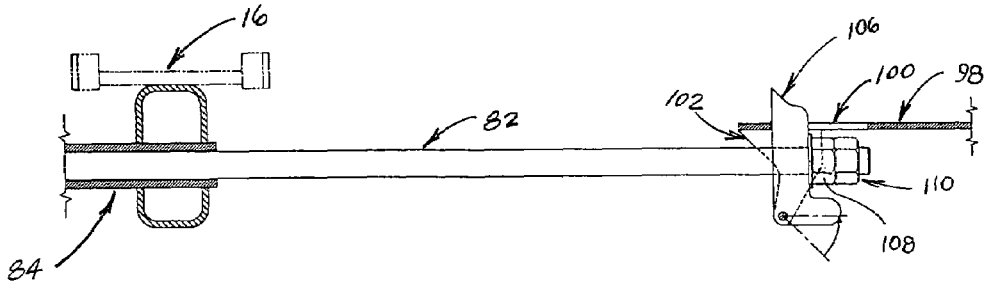
FIG. 9B is a partial view of the first pipe handler stop assembly of FIG. 9A, showing the rocker arm in engagement with the stop of the inner end of the column selector rod.

FIGS. 5-8 illustrate preferred embodiments of several of the components of a pipe handling assembly. As shown therein, a pipe handler assembly track comprised of first track portion 52 and second track portion 54 is attached to thrust frame 16 and disposed generally perpendicular to thrust frame axis 19. Pipe handler carrier 56 is mounted on the pipe handler assembly track and is adapted to be moved along direction line 58 (shown in FIG. 5) by a pair of linear actuators, one on each side (only one of which, actuator 60, is shown in FIG. 8). As best shown in FIG. 6, preferred pipe handler carrier 56 includes a pair of square tubing sections 62 and 64 that are adapted to slide within U-shaped first and second track portions 52 and 54 respectively of the pipe handler assembly track. Mounted adjacent to the pipe handler carrier is pipe section magazine 66. As shown in FIG. 8, magazine 66 includes columns 68, 70, 72, 74 and 76. A plurality of pipe sections (not shown) may be received and stored in each column. Each column of magazine 66 is open at the bottom so that a pipe section may be discharged therefrom under the influence of gravity. Pipe handler carrier 56 includes a pair of planar pipe supports 78 and 80 that support the pipes in any column of the magazine that is disposed thereabove. However, pipe handler carrier 56 may be moved along the pipe handler assembly track, as described in more detail hereinafter, to a plurality of positions in each of which a pipe section at the bottom of a column of the magazine is aligned with the transfer location. At each such location, the lowermost pipe section in the column of the magazine that is aligned with the transfer location will be discharged from the bottom of the selected column, while the lowermost pipe sections in other columns that are disposed over pipe supports 78 and 80 will be supported by such components and will remain in the magazine.

As shown in FIGS. 5-7D, preferred column selector rod 82 is mounted with respect to the thrust frame so as to selectively locate the pipe handler carrier along the pipe handler assembly track at a position to align a column of the magazine with the pipe section transfer location. More specifically, the preferred embodiment of the invention includes column selector guide tube 84 which is mounted to thrust frame 16 in a direction perpendicular to the thrust frame axis, and column selector rod 82 is mounted for axial movement within the column selector guide tube. Column selector rod 82 includes handle 86 at its outer end which is adapted to be selectively fixed with respect to the column selector guide tube at a plurality of locations, one for each column in the magazine. As shown in FIGS. 7A-7D, for example, column selector guide tube 84 includes slots 88, 90, 92, 94 and 96, each of which is adapted to receive handle 86 when the column selector rod is axially aligned in the guide tube so that the handle will rotate downwardly into the slot. In the preferred embodiment of the invention that is illustrated in the drawings, axially aligning column selector rod 82 in guide tube 84 so that handle 86 will be aligned with a slot in the guide tube serves to set a pair of stops for pipe handler carrier 56 with respect to the pipe handler assembly track. Setting such stops serves to stop the movement imparted to pipe handler carrier 56 by its associated linear actuators (including actuator 60, which is shown in FIG. 8) along the pipe handler assembly track at one of a plurality of positions each of which aligns a column of the magazine with the pipe section transfer location.

Generally, pipe handler carrier 56 is moved, during the drilling process, so as to align column 68 with the transfer location in order to remove all of the pipe sections, one after another, from such column. Then, when no pipe sections remain in column 68, the pipe handler carrier is moved to align column 70 with the transfer location in order to remove all of the pipe sections from such column. Thereafter, the pipe handler carrier is moved to align column 72 and then columns 74 and 76 with the pipe transfer location. When the assembly is operated to remove pipe sections from the drill string and replace them in the magazine, the preferred pipe handler carrier is moved so as to align column 76 with the pipe transfer location. The pipe section at the proximal end of the drill string is then disengaged from the drill string and an elevator (not shown) is used to raise the pipe section into the bottom of magazine 66 at column 76. When column 76 is completely filled with pipe sections, pipe handler carrier 56 is then moved to align column 74 with the pipe transfer section in order to fill this column of the magazine with pipe sections.

FIGS. 7A-7D illustrate the act of setting a stop (and thereby selecting a particular column of the magazine to align with the pipe section transfer location). As shown in FIG. 7A, column selector rod 82 is axially aligned in guide tube 84 and radially aligned so that handle 86 is within slot 94. This corresponds with setting a stop to obtain alignment of the pipe section transfer location with column 74 of magazine 66 (see FIG. 8). In order to change the column selection to align the pipe section transfer location with column 76 of the magazine, handle 86 is rotated 90° counterclockwise, as shown in FIG. 7B, and moved towards thrust frame 16 (thereby moving column selector rod 82 axially within guide tube 84) to align handle 86 with slot 96, as shown in FIG. 7C. Then handle 86 is rotated 90° clockwise, as shown in FIG. 7D, to set a stop to obtain alignment of the pipe section transfer location with column 76 of magazine 66, as shown in FIG. 8.

As shown in FIGS. 5, 6, 9A and 9B, pipe handler carrier 56 includes a base plate 98 that has rectangular slot 100 formed therein. Bracket 102 is mounted to the underside of base plate 98 and supports one end of cam shaft 104 which is adapted to rotate therein. The other end of cam shaft 104 is supported by cam shaft bracket 105 (shown in FIGS. 10A-11B). Rocker arm 106 is attached to the end of the cam shaft that is supported by bracket 102, thereby providing the structure for pivotally mounting the rocker arm to pipe handler carrier 56. Column selector rod 82 has an inner end which is threaded to receive stop nut 108, which is fixed in place on the column selector rod by jam nut 110. Stop nut 108 is located on the inner end of column selector rod 82 so as to be arranged and adapted with respect to handle 86 that selectively fixing the handle of the column selector rod with respect to the column selector guide tube in a particular slot in guide tube 84 will stop movement of the pipe handler carrier along the pipe handler assembly track at one of a plurality of positions, each of which aligns a column of the magazine with the pipe section transfer location. The precise location of stop nut 108 and jam nut 110 on the inner end of column selector rod 82 may be adjusted, if necessary, to insure that the placement of handle 86 in a particular slot in guide tube 84 will result in proper alignment of the pipe section transfer location with the appropriate column of the pipe section magazine.

When a column has been selected as described herein, the linear actuators associated with pipe handler carrier 56 may be engaged to move the pipe handler carrier along directional line 58 with respect to the pipe handler assembly track. As base plate 98 of pipe handler carrier 56 moves to the right as viewed in FIG. 9A, stop nut 98 will engage with and rotate rocker arm 106 until it reaches the configuration shown in FIG. 9B. This will serve to align the selected column of magazine 66 with the pipe section transfer location and will stop further movement of the pipe handler carrier with respect to the pipe handler assembly track.

In the preferred embodiments of the invention which are illustrated in the drawings, a second pipe handler carrier stop assembly is provided that is arranged and adapted to cooperate with the stop assembly which includes rocker arm 106. By providing two pipe handler carrier stop assemblies that operate cooperatively, guide tube 84 need not be centered with respect to pipe handler carrier 56, but may be located at any position along thrust frame 16 so as to be readily accessible by an operator. In addition, by providing two pipe handler carrier stop assemblies as described herein, the risk of binding or misalignment of square tubing sections 62 and 64 of pipe handler carrier 56 within U-shaped first and second track portions 52 and 54 of the pipe handler assembly track may be reduced. This risk is reduced because the preferred pipe handler carrier stop assemblies are spaced apart and inherently synchronized so as to operate cooperatively, because of the physical relationship of their various components.

One embodiment of the second pipe handler carrier stop assembly is illustrated in FIGS. 5, 6, 10A and 10B. A second embodiment of the second pipe handler carrier stop assembly is illustrated in FIGS. 11A and 11B. In both of these embodiments of the second pipe handler carrier stop assembly, cam 112 is mounted on the end of cam shaft 104 that is supported by cam shaft bracket 105, and base plate 98 of pipe handler carrier 56 includes a plurality of slots 114, 116, 118, 120 and 122 formed therein.

Figure 10A:
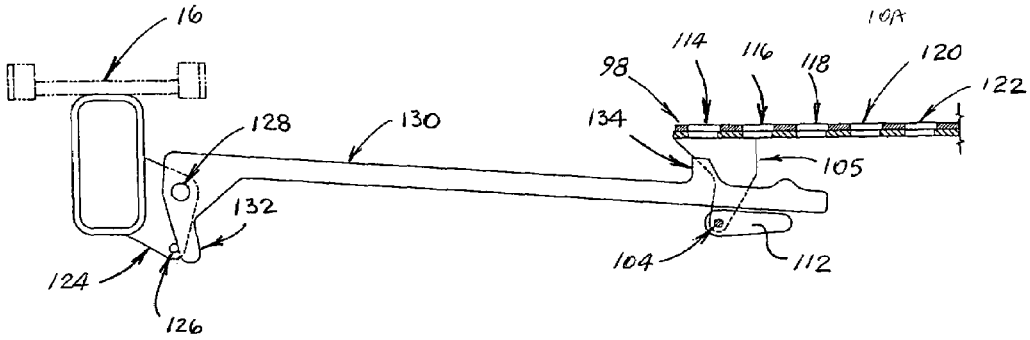
FIG. 10A is a partial view of a first embodiment of a second pipe handler stop assembly.
Figure 10B:
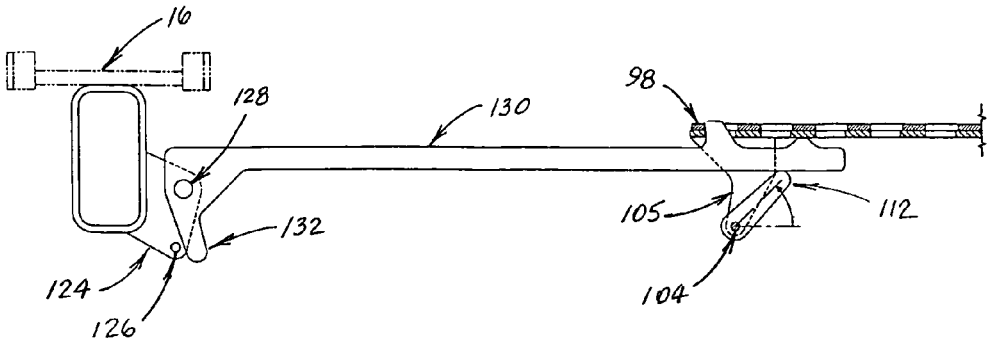
FIG. 10B is a partial view of the embodiment of the second pipe handler stop assembly of FIG. 10A, showing the hook engaged in one of the slots in the pipe handler carrier.
Figure 11A:
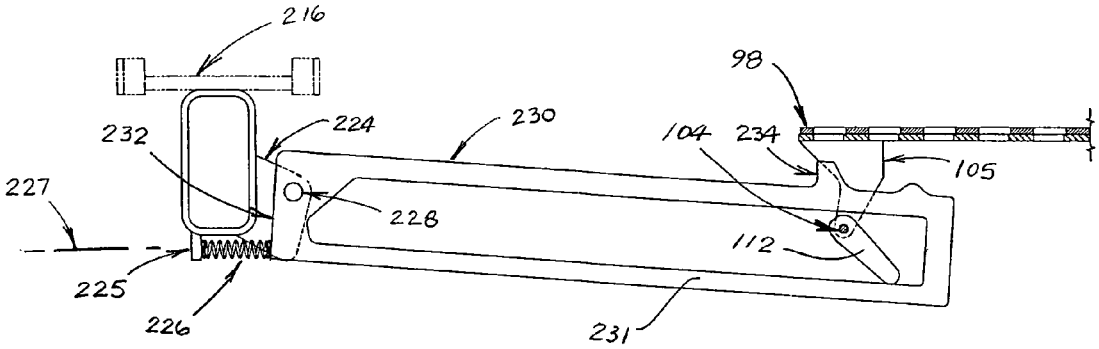
FIG. 11A is a partial view of a second embodiment of a second pipe handler stop assembly.
Figure 11B:
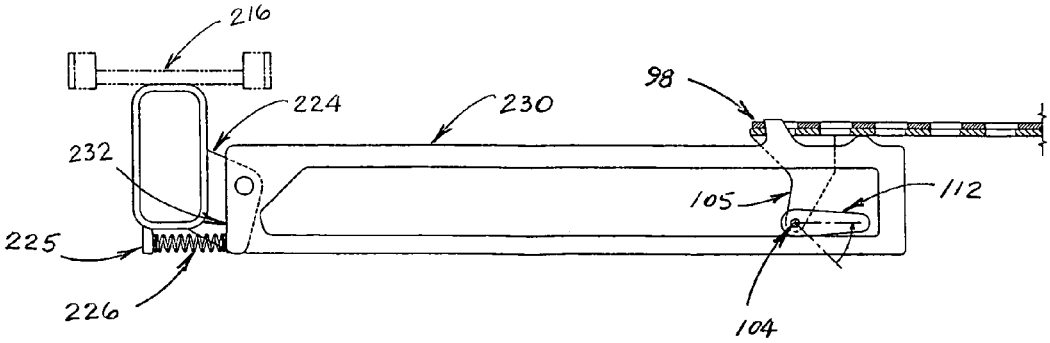
FIG. 11B is a partial view of the embodiment of the second pipe handler stop assembly of FIG. 11A, showing the hook engaged in one of the slots in the pipe handler carrier.

Referring now to FIGS. 10A and 10B, bracket 124 is attached to the lower end of thrust frame 16 and includes a rest stop pin 126. Pivotally attached to bracket 124 at pivot 128 is the base end of hook arm 130. Also attached to the base end of the hook arm is rest arm 132, which is supported by rest stop pin 126 when this embodiment of the second pipe handler carrier stop assembly is in the configuration shown in FIG. 10A. The opposite end (or hook end) of the hook arm includes hook 134 for selectively engaging with one of the slots in the pipe handler carrier. Referring again to FIGS. 9A and 9B, it can be seen that as base plate 98 of pipe handler carrier 56 moves to the right as viewed in FIG. 9A, stop nut 98 will engage with and rotate rocker arm 106 until it reaches the configuration shown in FIG. 9B. Since rocker arm 106 is fixed to the rocker arm end of cam shaft 104 and since cam 112 is fixed to the cam end of cam shaft 104, rotation of the rocker arm will also rotate the cam shaft in the same direction, thereby rotating cam 112 in the same direction from the first position shown in FIG. 10A to the second position shown in FIG. 10B. When the handling assembly of machine 10 is provided with the embodiment of the second pipe handler carrier stop assembly that is illustrated in FIGS. 10A and 10B, cam 112 will be in the first position (shown in FIG. 10A) when rocker arm 106 is in the position shown in FIG. 9A. As base plate 98 of pipe handler carrier 56 moves to the right as viewed in FIG. 9A, rocker arm 106 will rotate, preferably by about 45°, until it reaches the configuration shown in FIG. 9B. This will also serve to rotate cam 112 from the first position shown in FIG. 10A to the second position shown in FIG. 10B. As cam 112 rotates, it applies an upward force to the lower side of hook arm 130, thereby urging hook 134 into engagement with one of the slots in base plate 98 of the pipe handler carrier.

In the embodiment of the second pipe handler carrier stop assembly that is illustrated in FIGS. 10A and 10B, cam 112 is adapted to pivot with respect to cam shaft bracket 105 as the cam shaft is turned between a first position in which the hook is disengaged from all of the slots in the pipe handler carrier to a second position in which the hook engages one of the slots in the pipe handler carrier. Since the preferred second pipe handler carrier stop assembly is inherently synchronized with the preferred first pipe handler carrier stop assembly (because of the physical relationship of their various respective components), the particular slot that is engaged will depend on the relative position of column selector rod 82 in guide tube 84, as described above in connection with the discussion of the first pipe handler carrier stop assembly.

In the embodiment of the second pipe handler carrier stop assembly that is illustrated in FIGS. 11A and 11B, bracket 224 is attached to the lower end of thrust frame 216 and includes a spring support 225. Pivotally attached to bracket 224 at pivot 228 is the base end of hook arm 230. Also attached to the base end of the hook arm is spring engagement surface 232, and compression spring 226 is mounted between spring support 225 and spring engagement surface 232. When this embodiment of the second pipe handler carrier stop assembly is in the configuration shown in FIG. 11A, compression spring 226 applies a force along spring axis 227 to spring engagement surface 232. The opposite end (or hook end) of hook arm 230 includes hook 234 for selectively engaging with one of the slots in the pipe handler carrier. Referring again to FIGS. 9A and 9B, it can be seen that as base plate 98 of pipe handler carrier 56 moves to the right as viewed in FIG. 9A, stop nut 98 will engage with and rotate rocker arm 106 until it reaches the configuration shown in FIG. 9B. Since rocker arm 106 is fixed to the rocker arm end of cam shaft 104 and since cam 112 is fixed to the cam end of cam shaft 104, rotation of the rocker arm will also rotate the cam shaft in the same direction, thereby rotating cam 112 in the same direction from the first position shown in FIG. 11A to the second position shown in FIG. 11B. When cam 112 is in the first position shown in FIG. 11A, it applies a downward force to lower leg 231 of hook arm 230, which overcomes the spring force applied to the spring engagement surface 232 of the hook arm. When the handling assembly of machine 10 is provided with the embodiment of the second pipe handler carrier stop assembly that is illustrated in FIGS. 11A and 11B, cam 112 will be in the first position (shown in FIG. 11A) when rocker arm 106 is in the position shown in FIG. 9A. As base plate 98 of pipe handler carrier 56 moves to the right as viewed in FIG. 9A, rocker arm 106 will rotate, preferably by about 45°, until it reaches the configuration shown in FIG. 9B. This will also serve to rotate cam 112 from the first position shown in FIG. 11A to the second position shown in FIG. 11B. As cam 112 rotates, the downward force it applies to lower leg 231 of hook arm 230 is relieved, thereby allowing spring 226 to urge hook 234 into engagement with one of the slots in base plate 98 of the pipe handler carrier.

In the embodiment of the second pipe handler carrier stop assembly that is illustrated in FIGS. 11A and 11B, cam 112 is adapted to pivot with respect to cam shaft bracket 105 as the cam shaft is turned between a first position in which the hook is disengaged from all of the slots in the pipe handler carrier to a second position in which the hook engages one of the slots in the pipe handler carrier. Of course, the particular slot that is engaged will depend on the relative position of column selector rod 82 in guide tube 84.

FIGS. 8 and 12A-12C illustrate preferred pipe retaining assembly 300 that may be employed in connection with the handling assembly of the invention. Portions of assembly 300 are also illustrated in FIGS. 5 and 6. This pipe retaining assembly acts to restrain a pipe section against rotation and/or axial motion so that new pipe sections may be joined to, or removed from, the drill string. Preferably, two pipe retaining assemblies are employed in connection with pipe handler carrier 56, one located beneath pipe support 78 and the other located beneath pipe support 80 (shown in FIGS. 5 and 6). Pipe retaining assembly 300 includes a pipe receiver for receiving a pipe section, which pipe receiver comprises parallel pipe receiver wall sections 302 and 304 that include extensions 306 and 308, respectively (see FIGS. 5, 6 and 12A-12C). A similar pipe retaining assembly, including pipe receiver wall sections 310 and 312 and corresponding extensions, is mounted on the opposite side of pipe handler carrier 56 in a preferred embodiment of the invention. A pair of pivoting pipe support arms 314 and 316 (not shown in FIGS. 8 and 12A-12C) are mounted outside wall sections 302 and 312, respectively, and are adapted to assist in retaining the pipe sections in the pipe section transfer location.

Referring now to FIGS. 8 and 12A-12C, pipe retaining assembly 300 includes preferred pipe gripper 318 which is pivotally attached to the pipe receiver between extensions 306 and 308 so as to pivot about pipe gripper pivot 320. Pipe gripper 318 is adapted to cooperate with the pipe receiver to hold a pipe section. Preferred pipe retaining assembly 300 includes means for applying a first gripping force and a second gripping force to the pipe section in the pipe receiver. Preferably, the first gripping force is applied when pipe sections are added to the drill string to prevent the pipe section in the pipe transfer location from moving axially (since the thrust frame is oriented at an angle), while allowing rotation in order to facilitate alignment and mating with the drill string. Once alignment and mating of the pipe section in the pipe transfer location have been assured, the second gripping force is applied to prevent rotation. Both gripping forces are preferably applied by linear actuators, which operate to apply linear forces between the pipe receiver and the pipe gripper. However, in the preferred embodiment illustrated in the drawings, the linear forces are applied in two different force directions.

Figure 12A:
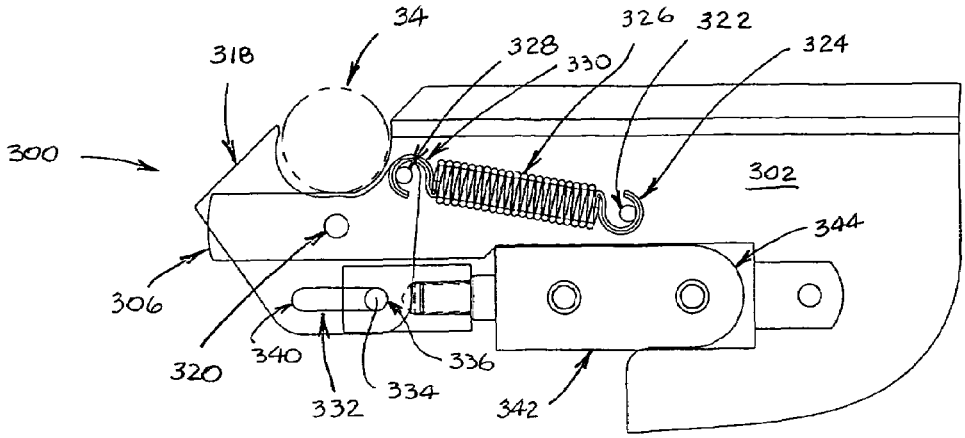
FIG. 12A is a partial side view of a preferred embodiment of the pipe gripper assembly, showing the assembly with no grip force being applied to a pipe section.
Figure 12B:
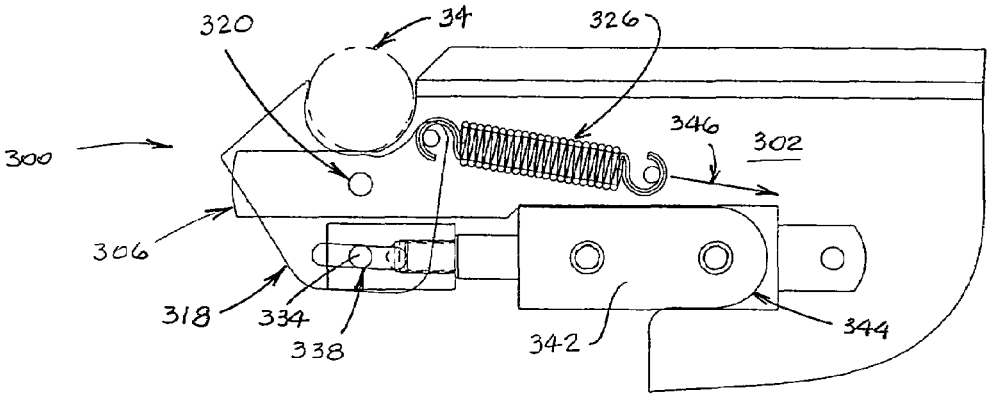
FIG. 12B is a partial side view of the pipe gripper assembly of FIG. 12A, showing the application of a first gripping force.
Figure 12C:
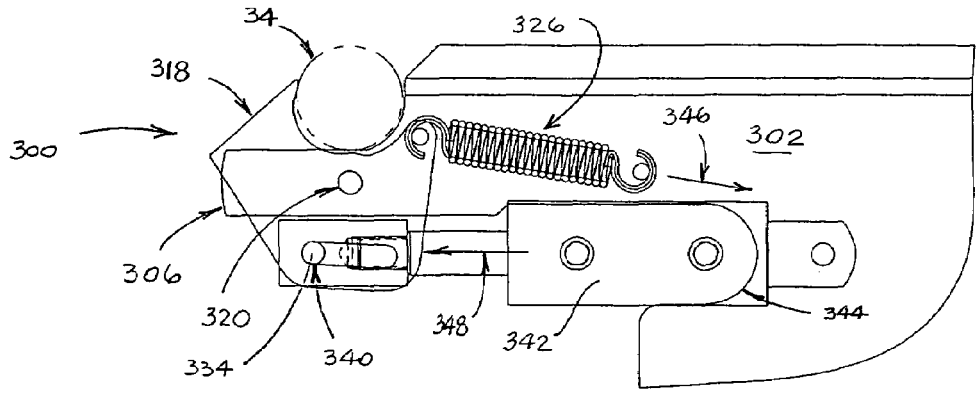
FIG. 12C is a partial side view of the pipe gripper assembly of FIG. 12A, showing the application of a second gripping force.

FIG. 12A illustrates the condition of pipe section 34 in pipe retaining assembly 300 when no gripping force is applied. FIG. 12B illustrates the application of a first gripping force, and FIG. 12C illustrates the continuation of the first gripping force and the application of a second gripping force. As shown in these drawings, pipe receiver wall section 302 includes pin 322 for receiving first end 324 of tension spring 326. Pipe gripper 318 also includes pin 328 for receiving second end 330 of tension spring 326. Furthermore, in the preferred embodiment of the invention illustrated in the drawings, pipe gripper pin 328 is located above pipe gripper pivot 320. Pipe gripper 318 also includes slot 332 for receiving clevis pin 334. Pipe gripper slot 332 has first end 336 (indicated by the location of clevis pin 334 in FIG. 12A), intermediate position 338 (indicated by the location of clevis pin 334 in FIG. 12B) and second end 340 (indicated by the location of clevis pin 334 in FIG. 12C). Pipe gripper slot 332 is located below pipe gripper pivot 320. Preferred pipe retaining assembly 300 also includes a linear actuator in the form of hydraulic actuator 342, which includes base end 344 that is attached to the pipe receiver and a rod end to which clevis pin 334 is attached. As shown in FIGS. 12A and 12B, pipe receiver pin 322, pipe gripper pin 328, pipe gripper slot 332, tension spring 326, hydraulic actuator 342 and clevis pin 334 are arranged and adapted so that extension of the rod end of actuator 342 will cause clevis pin 334 to move from the first end of the pipe gripper slot (shown in FIG. 12A) to the intermediate position (shown in FIG. 12B). This action will cause tension spring 326 to apply a first linear force, in the first force direction indicated by arrow 346, to the pipe gripper, which in turn will pivot about pipe gripper pivot 320 to apply a first gripping force to pipe section 34 in the pipe section transfer location. Furthermore, as the rod end of actuator 342 is further extended to cause clevis pin 334 to move from the intermediate position (shown in FIG. 12B) to the second end of the pipe gripper slot (shown in FIG. 12C), actuator 342 will apply a second linear force, in the second force direction indicated by arrow 348, to the pipe gripper, which in turn will apply a second gripping force to the pipe section in the pipe section transfer location. This second gripping force will reinforce the first gripping force to more securely hold the pipe section and prevent it from rotating in the pipe section transfer location.

Of course, as will be appreciated by those having ordinary skill in the art to which the invention relates, other linear actuators than those described and illustrated herein may be employed in connection with the invention. Furthermore, other pipe retaining assemblies may be employed in connection with the handling assembly for pipe sections for a horizontal directional drill that is described herein.

Although much of this description has been directed to describing the operation of the invention in connection with adding pipe sections to a drill string during a drilling operation, those having ordinary skill in the art will appreciate that the invention may also be employed, in essentially the same manner, in removing pipe sections from a drill string during a backreaming operation.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A handling assembly for pipe sections for a horizontal directional drill, said handling assembly comprising:

(a) a thrust frame having a thrust frame axis;

(b) a drive carriage that is mounted on the thrust frame and adapted to be driven along the thrust frame axis;

(c) a pipe-rotation mechanism that is mounted on the drive carriage, said pipe-rotation mechanism and thrust frame defining a pipe section transfer location;

(d) a pipe handler assembly track that is attached to the thrust frame and disposed generally perpendicular to the thrust frame axis;

(e) a pipe handler carrier that is mounted on the pipe handler assembly track;

(f) a magazine that is mounted adjacent to the pipe handler carrier, said magazine having a plurality of columns within each of which a plurality of pipe sections may be received and stored, the magazine being adapted to discharge a pipe section from the bottom of each column;

(g) means for moving the pipe handler carrier along the pipe handler assembly track to a plurality of positions in each of which a pipe section at the bottom of a column of the magazine is aligned with the transfer location;

(h) a column selector guide tube that is mounted to the thrust frame in a direction perpendicular to the thrust frame axis;

(i) a column selector rod that is mounted for axial movement within the column selector guide tube, said column selector rod having:

(1) an outer end that is adapted to be selectively fixed with respect to the column selector guide tube at a plurality of locations, one for each column in the magazine;

(2) an inner end with a stop for the pipe handler carrier;

whereby the outer end and inner end stop are arranged and adapted so that selectively fixing the outer end of the column selector rod with respect to the column selector guide tube at a particular location will stop movement of the pipe handler carrier along the pipe handler assembly track at one of a plurality of positions each of which aligns a column of the magazine with the pipe section transfer location.

2. The handling assembly of claim 1 which includes a pipe retaining assembly comprising:

(a) a pipe receiver for receiving a pipe section;

(b) a pipe gripper which is:

(i) pivotally attached to the pipe receiver so as to pivot about a pipe gripper pivot;

(ii) adapted to cooperate with the pipe receiver to hold a pipe section;

(c) means for applying a first linear force to the pipe gripper;

(d) means for applying a second linear force to the pipe gripper.

3. The handling assembly of claim 2 wherein:

(a) the means for applying a first linear force to the pipe gripper comprises a linear actuator;

(b) the means for applying a second linear force to the pipe gripper comprises a linear actuator.

4. The handling assembly of claim 3 wherein the first linear force is applied in a first force direction, the second linear force is applied in a second force direction, and the first force direction is different from the second force direction.

5. The handling assembly of claim 1 which includes a pipe retaining assembly comprising:

(a) a pipe receiver for receiving a pipe section;

(b) means for applying a first gripping force to the pipe section in the pipe receiver;

(c) means for applying a second gripping force to the pipe section in the pipe receiver.

6. The handling assembly of claim 5 wherein:

(a) the pipe retaining assembly includes a pipe gripper that is pivotally attached to the pipe receiver so as to pivot about a pipe gripper pivot;

(b) the means for applying a first gripping force to the pipe section comprises a tension spring that is attached between the pipe receiver and the pipe gripper.

7. The handling assembly of claim 5 wherein:

(a) the pipe retaining assembly includes a pipe gripper that is pivotally attached to the pipe receiver so as to pivot about a pipe gripper pivot;

(b) the means for applying a second gripping force to the pipe section comprises a linear actuator that is attached between the pipe receiver and the pipe gripper.

8. A handling assembly for pipe sections for a horizontal directional drill, said handling assembly comprising:

(a) a thrust frame having a thrust frame axis;

(b) a drive carriage that is mounted on the thrust frame and adapted to be driven along the thrust frame axis;

(c) a pipe-rotation mechanism that is mounted on the drive carriage, said pipe-rotation mechanism and thrust frame defining a pipe section transfer location;

(d) a pipe handler assembly track that is attached to the thrust frame and disposed generally perpendicular to the thrust frame axis;

(e) a pipe handler carrier that is mounted on the pipe handler assembly track;

(f) a magazine that is mounted adjacent to the pipe handler carrier, said magazine having a plurality of columns within each of which a plurality of pipe sections may be received and stored, the magazine being adapted to discharge a pipe section from the bottom of each column;

(g) means for moving the pipe handler carrier along the pipe handler assembly track to a plurality of positions in each of which a pipe section at the bottom of a column of the magazine is aligned with the transfer location;

(h) a column selector rod that is mounted with respect to the thrust frame so as to selectively locate the pipe handler carrier along the pipe handler assembly track at a position to align a column of the magazine with the pipe section transfer location;

(i) a first pipe handler carrier stop assembly comprising:

(1) a column selector guide tube that is mounted to the thrust frame in a direction perpendicular to the thrust frame axis;

(2) a column selector rod which:

(A) is mounted for axial movement within the column selector guide tube;

(B) has an outer end that is adapted to be selectively fixed with respect to the column selector guide tube at a plurality of locations, one for each column in the magazine;

(C) has an inner end with a stop;

(3) a rocker arm that is pivotally mounted to the pipe handler carrier, said rocker arm being adapted to engage with the stop of the inner end of the column selector rod to stop movement of the pipe handler carrier along the pipe handler assembly track at one of a plurality of positions each of which aligns a column of the magazine with the pipe section transfer location.

9. The handling assembly of claim 8:

(a) wherein the pipe handler carrier includes a plurality of slots therein;

(b) which includes a second pipe handler carrier stop assembly which is adapted to cooperate with the first pipe handler carrier stop assembly to stop movement of the pipe handler carrier along the pipe handler assembly track at one of a plurality of positions each of which aligns a column of the magazine with the pipe section transfer location, said second pipe handler carrier stop assembly comprising:

(1) a cam shaft bracket that is spaced from the rocker arm and attached to the pipe handler carrier;

(2) a cam shaft having a rocker arm end and a cam end, said rocker arm end being fixed to the rocker arm and said cam shaft being mounted for rotation in the cam shaft bracket;

(3) a hook arm having a base end and a hook end, said base end being pivotally attached to the thrust frame and said hook end having a hook for selectively engaging with one of the slots in the pipe handler carrier;

(4) a cam that is attached to the cam end of the cam shaft and adapted to pivot with respect to the cam shaft bracket as the cam shaft is turned;

wherein said slots, cam shaft bracket, cam shaft, hook, hook arm and cam are arranged and adapted so that as the cam shaft is turned, the hook arm moves from a disengaged position in which the hook is disengaged from all of the slots in the pipe handler carrier to an engaged position in which the hook engages one of the slots in the pipe handler carrier.

10. The handling assembly of claim 9 wherein the slots, cam shaft bracket, cam shaft, hook, hook arm and cam are arranged and adapted so that the hook arm moves from a disengaged position in which the hook is disengaged from all of the slots in the pipe handler carrier to an engaged position in which the hook engages one of the slots in the pipe handler carrier as the cam shaft rotates to move the cam from a first position to a second position.

11. The handling assembly of claim 10 wherein the slots, cam shaft bracket, cam shaft, hook, hook arm and cam are arranged and adapted so that the hook arm moves from a disengaged position in which the hook is disengaged from all of the slots in the pipe handler carrier to an engaged position in which the hook engages one of the slots in the pipe handler carrier as the cam shaft rotates through an angle of about 45°.

12. The handling assembly of claim 9 wherein the second pipe handler carrier stop assembly includes means for supporting the hook arm in the disengaged position.

13. The handling assembly of claim 12 wherein the means for supporting the hook arm in the disengaged position comprises:

(a) a rest arm that is attached to the base end of the hook arm;

(b) a rest stop that is mounted on the thrust frame adjacent to the base end of the hook arm;

said rest arm and rest stop being adapted and arranged so that the rest arm engages the rest stop when the hook arm is in the disengaged position.

14. The handling assembly of claim 9 wherein the second pipe handler carrier stop assembly includes means for holding the hook arm in the engaged position.

15. The handling assembly of claim 14 wherein:

(a) the base end of the hook arm includes a spring engagement surface;

(b) the means for holding the hook arm in the engaged position comprises a compression spring that is attached between the thrust frame and the spring engagement surface and adapted to urge the hook arm towards the engaged position.

16. A handling assembly for pipe sections for a horizontal directional drill, said handling assembly comprising:

(a) a thrust frame having a thrust frame axis;

(b) a drive carriage that is mounted on the thrust frame and adapted to be driven along the thrust frame axis;

(c) a pipe-rotation mechanism that is mounted on the drive carriage, said pipe-rotation mechanism and thrust frame defining a pipe section transfer location;

(d) a pipe handler assembly track that is attached to the thrust frame and disposed generally perpendicular to the thrust frame axis;

(e) a pipe handler carrier that is mounted on the pipe handler assembly track;

(f) a magazine that is mounted adjacent to the pipe handler carrier, said magazine having a plurality of columns within each of which a plurality of pipe sections may be received and stored, the magazine being adapted to discharge a pipe section from the bottom of each column, (g) means for moving the pipe handler carrier along the pipe handler assembly track to a plurality of positions in each of which a pipe section at the bottom of a column of the magazine is aligned with the transfer location;

(h) a column selector rod that is mounted with respect to the thrust frame so as to selectively locate the pipe handler carrier along the pipe handler assembly track at a position to align a column of the magazine with the pipe section transfer location;

(i) a pipe retaining assembly comprising:

(1) a pipe receiver for receiving a pipe section, said pipe receiver having a pipe receiver pin;

(2) a pipe gripper that is pivotally attached to the pipe receiver so as to pivot about a pipe gripper pivot, said pipe gripper having:

(A) a pipe gripper pin that is located above the pipe gripper pivot;

(B) a pipe gripper slot for receiving a clevis pin, said pipe gripper slot having a first end, an intermediate position and a second end, and being located below the pipe gripper pivot;

(3) a tension spring having a first end and a second end, said first end being attached to the pipe receiver pin and said second end being attached to the pipe gripper pin;

(4) a linear actuator having:

(A) a base end that is attached to the pipe receiver;

(B) a rod end having a clevis pin attached thereto, said clevis pin being received in the pipe gripper slot;

wherein the pipe receiver pin, pipe gripper pin, pipe gripper slot, tension spring, linear actuator and clevis pin are arranged and adapted so that:

(5) extension of the rod end to cause the clevis pin to move from the first end of the pipe gripper slot to the intermediate position will cause the tension spring to apply a first linear force to the pipe gripper;

(6) extension of the rod end to cause the clevis pin to move from the intermediate position to the second end of the pipe gripper slot will cause the linear actuator to apply a second linear force to the pipe gripper.

* * * * *